United States Patent [19]

Termohlen

[11] Patent Number: 4,690,212

[45] Date of Patent: Sep. 1, 1987

[54] DRILLING PIPE FOR DOWNHOLE DRILL MOTOR

[76] Inventor: David E. Termohlen, 23 W. 4th St., Tulsa, Okla. 74103

[21] Appl. No.: 352,374

[22] Filed: Feb. 25, 1982

[51] Int. Cl.[4] ..... E21B 47/00; E21B 17/042

[52] U.S. Cl. ..... 166/65.1; 175/104; 439/191

[58] Field of Search ..... 166/65 R; 174/47; 175/104, 105, 320; 285/288, 305, 330, DIG. 14; 339/15, 16 C, 16 R, 48, 49 B, 91 R; 340/856, 857, 858

[56] References Cited

U.S. PATENT DOCUMENTS

| | | | |
|---|---|---|---|
| 1,126,848 | 11/1978 | Denison | 174/47 |
| 2,479,483 | 8/1949 | Ekleberry | 339/16 R |
| 3,709,528 | 1/1973 | Cruse | 285/330 |
| 3,866,678 | 2/1975 | Jeter | 175/104 |
| 4,121,193 | 10/1978 | Denison | 339/16 R |

*Primary Examiner*—Stephen J. Novosad
*Assistant Examiner*—William P. Neuder
*Attorney, Agent, or Firm*—Head Johnson Stevenson

[57] ABSTRACT

A drilling pipe and pipe connection system for maintaining electric connection between the surface and a subsurface location during drilling having sidewalls consisting of a bundle of parallel, longitudinally oriented, tightly packed wires cemented to each other thus creating a structural "reed bundling effect". Individual insulated conductive wires distributed around the reed bundled sidewall in two concentric subsets are attached to a pair of concentric electrical contact rings located at each end fitting such that when drilling pipe sections are interconnected electrical continuity is maintained. Such a drilling pipe is useful to deliver electricity to a downhole drilling motor or the like and for transmitting electrical signals or data during the drilling operation.

9 Claims, 7 Drawing Figures

DRILLING PIPE FOR DOWNHOLE DRILL MOTOR

BACKGROUND OF THE INVENTION (1) Field of the Invention:

This invention relates to an improved drilling pipe and drilling pipe connector system for use with a downhole electric motor. More specifically, the invention relates to a drilling pipe made from a bundle of rods or wires which also serves as an electrical conductor for the downhole motor.

(2) Description of the Prior Art

Commercial drilling for oil and gas, whether it be on land or offshore, usually involves the use of a rotary drill bit attached to the end of a drilling pipe string suspended from a drilling rig at the surface of the earth. By turning the drilling pipe at the surface, the drill bit at the bottom of the hole rotates and performs the desired drilling operation. Various alternatives to the traditional concept of rotary drilling have been suggested with limited degrees of commercial acceptance. For example, it is generally known to suspend a downhole motor on the end of the drilling string which drives the drill bit. Such a process can occasionally be used competitively particularly in shallow drilling operations where changing the drill bit is unnecessary. However, such techniques are not considered commercially attractive in moderate to deep drilling applications. One problem associated with the use of a downhole motor is the inability to conveniently deliver electrical current to the motor via electrical conductors suspended down the central core of the drill pipe. The nature of this problem can be more readily appreciated when one considers that during the drilling operation the drilling pipe must be occasionally removed from the well to replace the drill bit, place casing, and/or for other related operations. In order to do this, each section of the drilling pipe must be disassembled, but the presence of a continuous cable running from the surface down to the motor makes this task virtually impossible. The presence of the electrical cables also creates problems when a directional survey tool or the like is to be sent down the center of the drilling string. And the fact that it is critical that drilling mud be continuously circulated down the drilling string and back up the annulus between the string and the well bore during drilling makes the mere presence of the electrical cables a risk that is unacceptable in most drilling operations. In principle, these enumerated problems associated with the use of a downhole drill motor are equivalent to the reasons that make hard wire data transmission from downhole instrument packages (the so-called contemporary "measurement while drilling" techniques) an impractical approach to a very desirable end result.

SUMMARY OF THE INVENTION

In view of the problems associated with the transmission of electrical current to the downhole drilling motor and the transmission of the electrical signals between the surface and the downhole location during the drilling operation, I have discovered an improved drilling pipe and drilling pipe connector system that employs a "reed bundling effect" using a plurality of rods or wires bundled together with individual strands cemented to each other to make up the sidewalls of the drilling pipe wherein selected individual rods or strands of wire are employed to transmit an electrical current or signal.

Thus, the invention provides a drilling pipe for maintaining electrical connection between the surface and a subsurface location comprising: (a) a first fitting at one end of said pipe; (b) a second fitting at the other end of the pipe adapted to connect with a fitting like that at the first end; (c) a pipe sidewall interconnecting the end fittings and comprising a plurality of essentially parallel, tightly packed rods or wires cemented to each other wherein at least one of the rods or wires is electrically conductive and insulated from the rest of the pipe; and (d) an alignment means for making electrical contact between corresponding insulated rods or wires when the first fitting of one of the pipes is connected with the second fitting of another of the pipes. The present invention further provides for at least two separate subsets of the rods or wires being electrically insulated from the rest of the pipe and the subsets being isolated from each other thus completing an electrical circuit down the drilling string and back to the surface of the earth. Preferably, the alignment means comprises at least two concentric electrical contact rings at each end of the pipe fittings wherein the rings complete the electrical circuit between respective pipe sections when interconnected, thus establishing electrical continuity and maintaining electrical isolation of the subsets of the insulated rods or wires. In one embodiment the pipe fittings are splined to maintain axial alignment of the interconnected pipe sections and the splined fittings are retained in an assembled interconnected state by a concentric keeper means. In this manner the conductive rods or wires can be segregated into an even greater number of individual electrical circuits.

Thus, the present invention further provides for an improved melthod for drilling with an electric downhole motor involving the transmission of electrical current from the surface of the earth to the downhole electric motor through a drilling pipe as described above. The invention also provides for an improved method of transmitting data acquired during drilling (whether by downhole motor or by conventional rotary drilling) between the earth surface and a downhole locaion through a drilling pipe, again as previously decribed.

The primary object of the present invention is to provide an improved drilling pipe wherein an electrically conductive circuit becomes an integral structural component of the drilling pipe. It is an additional object of the invention to provide a drilling string that can be handled essentially the same way as a conventional drilling string even with a downhole motor, a downhole "measurement while drilling" instrument package, or both, being present. Fulfillment of these objects and the presence and fulfillment of other objects will be apparent upon reading the complete specification and claims taken in conjunction with the attached drawings.

DESCRIPTION OF THE PREFERRED EMBODIMENTS

Figure 1:
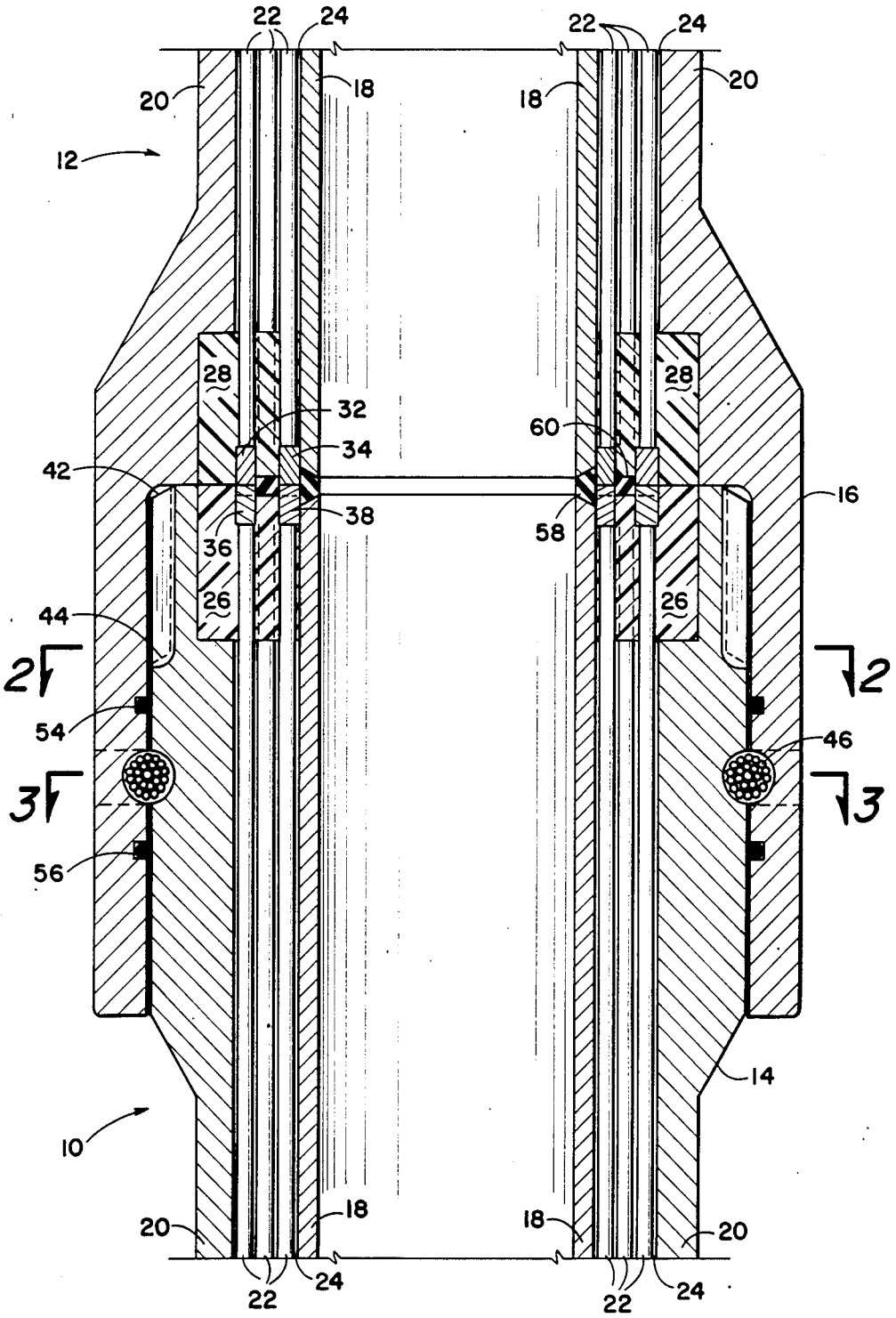
FIG. 1 illustrates a cross sectional view of the pipe connection between two sections of drilling pipe according to the present invention.

The improved drilling pipe according to the present invention, how it differs from previously known drilling pipe and the advantages of using it can perhaps be best explained and understood by reference to the accompanying drawings FIG. 1 illustrates a cross sectional side view of a connection between two assembled drilling pipe sections generally designate- by numerals 10 and 12. As illustrated, the male connector 14 of the lower pipe section 10 is inserted into the female connector 16 of the upper pipe section 12. Both pipe sections 10 and 12 are made up of an inner wall or conduit 18 and outer protective wall or conduit 20 with a plurality of essentially parallel, tightly packed support rods 22 bundled together in the annulus between the inner and outer walls. These individual support rods 22 are bound to each other by the presence of a cement 24 occupying the interstitial space between the rods. The support rods 22 exiting the main portion of the pipe enter the connectors 14 and 16 through fusion blocks 26 and 28, respectively. The fusion blocks 26 and 28 anchor the rods to the pipe connectors and maintain the alignment of the ends of the rods within the connectors.

Figure 2:
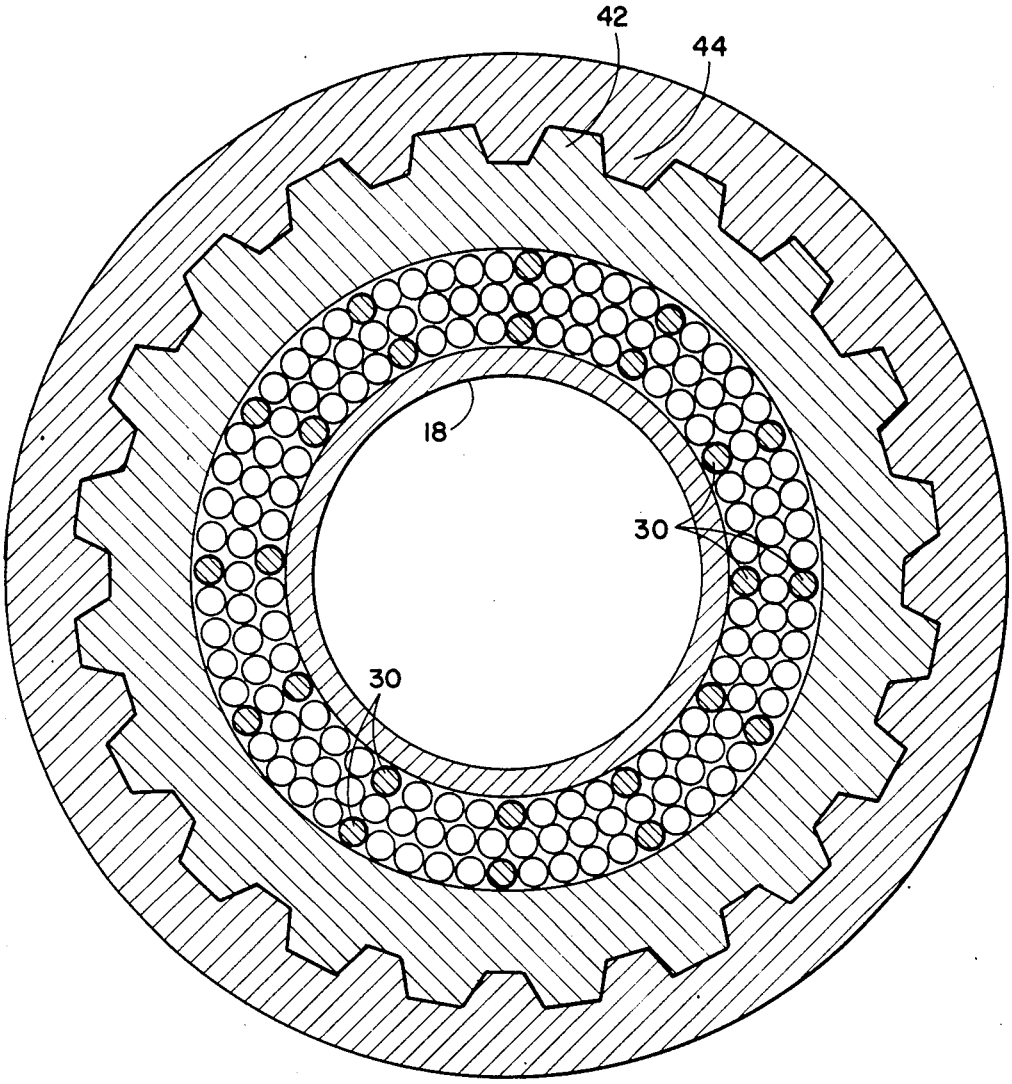
FIG. 2 is a cross sectional view of the drilling pipe connection of FIG. 1 as seen through line A—A.
Figure 4:
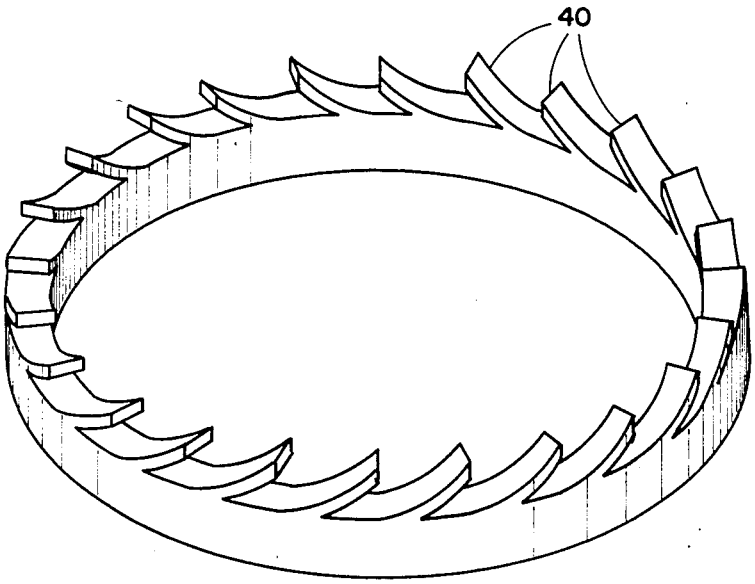
FIG. 4 illustrates an electrical connector ring of the drilling pipe connection of FIG. 1.

As illustrated in FIG. 2, selected rods 30 displaced in two concentric rings around the annulus between the pipe's inner and outer sidewalls are designated to carry an electrical current. As such rods 30 are made of a conductive material and are electrically insulated from the remainder of the pipe structure. Two sets of concentric electrical contact rings made up of upper rings 32 and 34 and lower rings 36 and 38 are recessed within the fusion block and are conductively attached to the respective conductor rods 30, thus establishing and maintaining electrical continuity across the pipe connection. The lower rings 36 and 38 are provided with flared upturned projections 40 (see FIG. 4) to insure electrical contact after repeated assembly and disassembly of the pipe joint.

Figure 3:
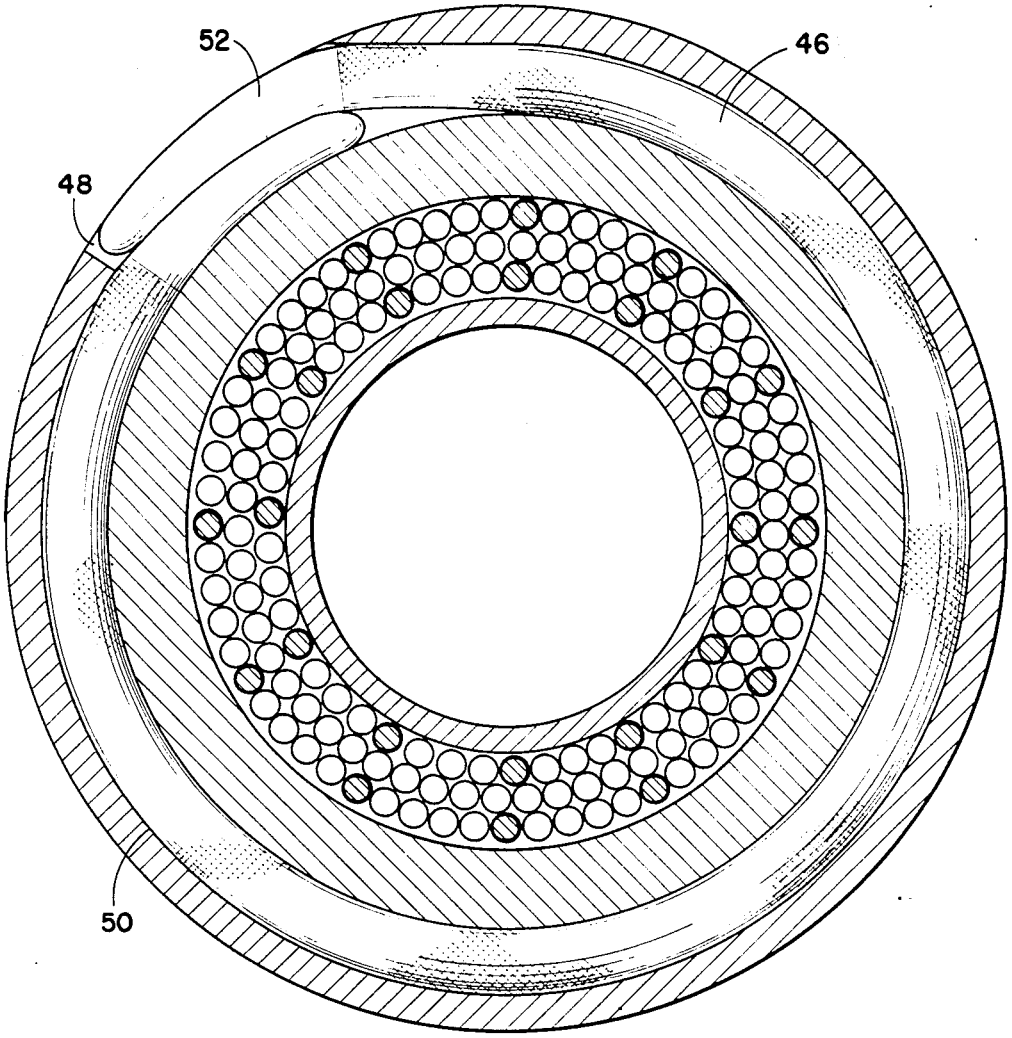
FIG. 3 is a cross sectional view of the drilling pipe connection of FIG. 1 as seen through line B—B.
Figure 5:
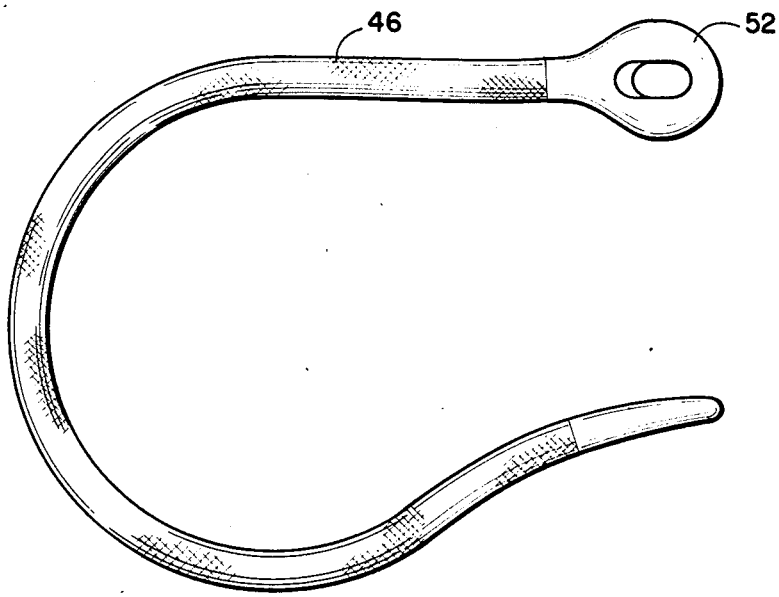
FIG. 5 illustrates the braided flexible keeper ring of FIG. 1.

FIG. 2 also illustrates the splined surfaces 42 and 44 of the upper and lower pipe connectors 14 and 16 which engage and hold the drilling pipe in axial alignment during use. The pipe connection of FIG. 1 is held together by threading the flexible keyway 46 of FIG. 5 through an external opening 48 (FIG. 3) and around an inner annular groove 50 between the male and female connectors 14 and 16. This feature can be more clearly seen in FIG. 3 wherein the flat head 52 of the keyway 46 remains flush to the exterior of the connection by receding into opening 48. The assembled connection between upper pipe 10 and lower pipe 12 is sealed by a pair of O-rings 54 and 56 and ring gaskets 58 and 60.

Figure 6:
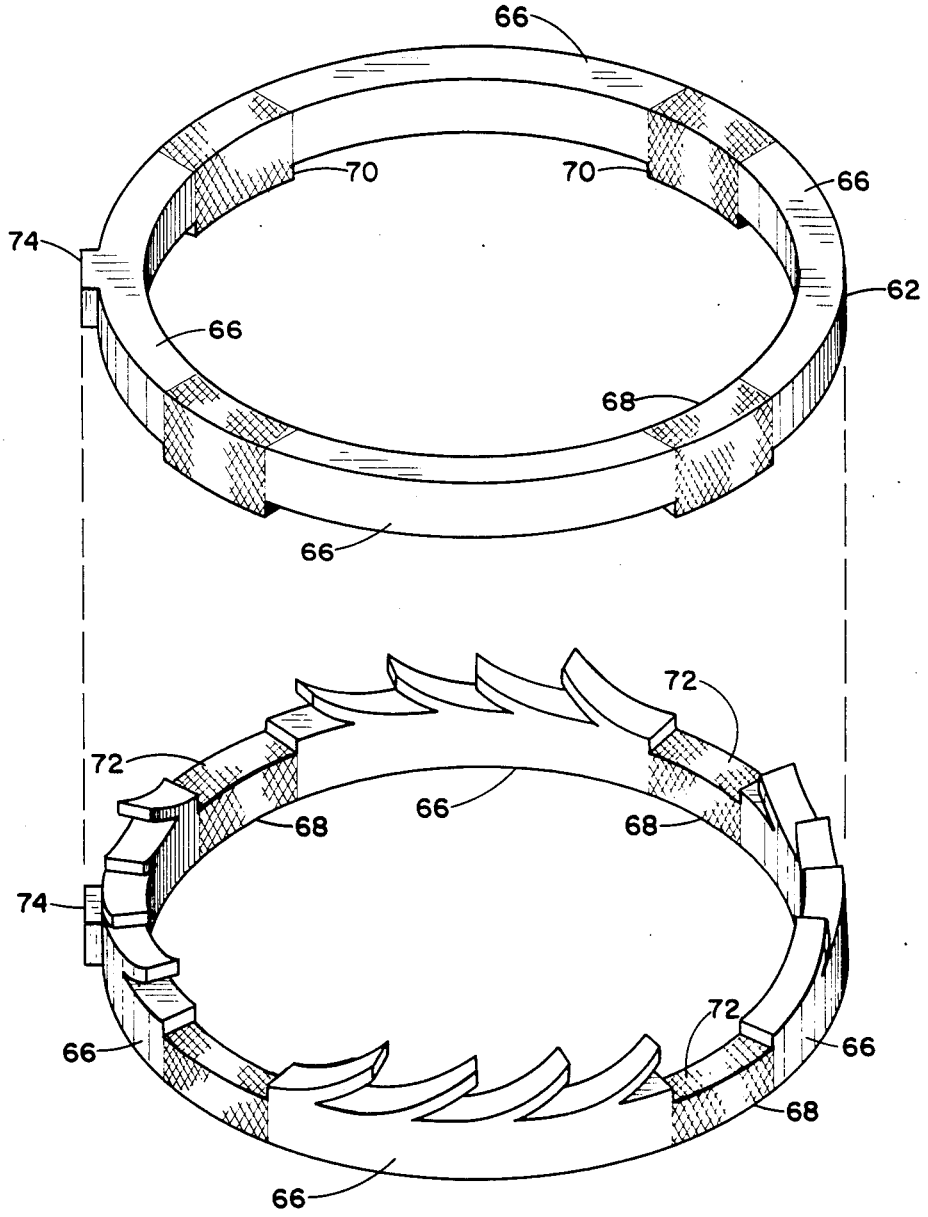
FIG. 6 illustrates a set of alternate electrical connector rings for maintaining multiple electrical circuits.

If a greater number of individual electrical circuits are required or desirable, conductive rods 30 can be grouped into a plurality of subsets. FIG. 6 illustrates a set of electrical connector rings 62 and 64 used in combination with a connector similar to that illustrated in FIG. 1 to accomplish this result. The connector rings 62 and 64 are segmented into a plurality of conductive regions 66 by insulated spacers 68. The spacers 68 are designed to align with each other by virtue of interlock protrusions 70 and recessions 72. Similarly, the rings fit into the connector in a specific orientation by virtue of tabs 74 and a corresponding recession in the fusion block (not shown). In this manner, the continuity of the plurality of electrical circuits across the drilling pipe connection is maintained.

Figure 7:
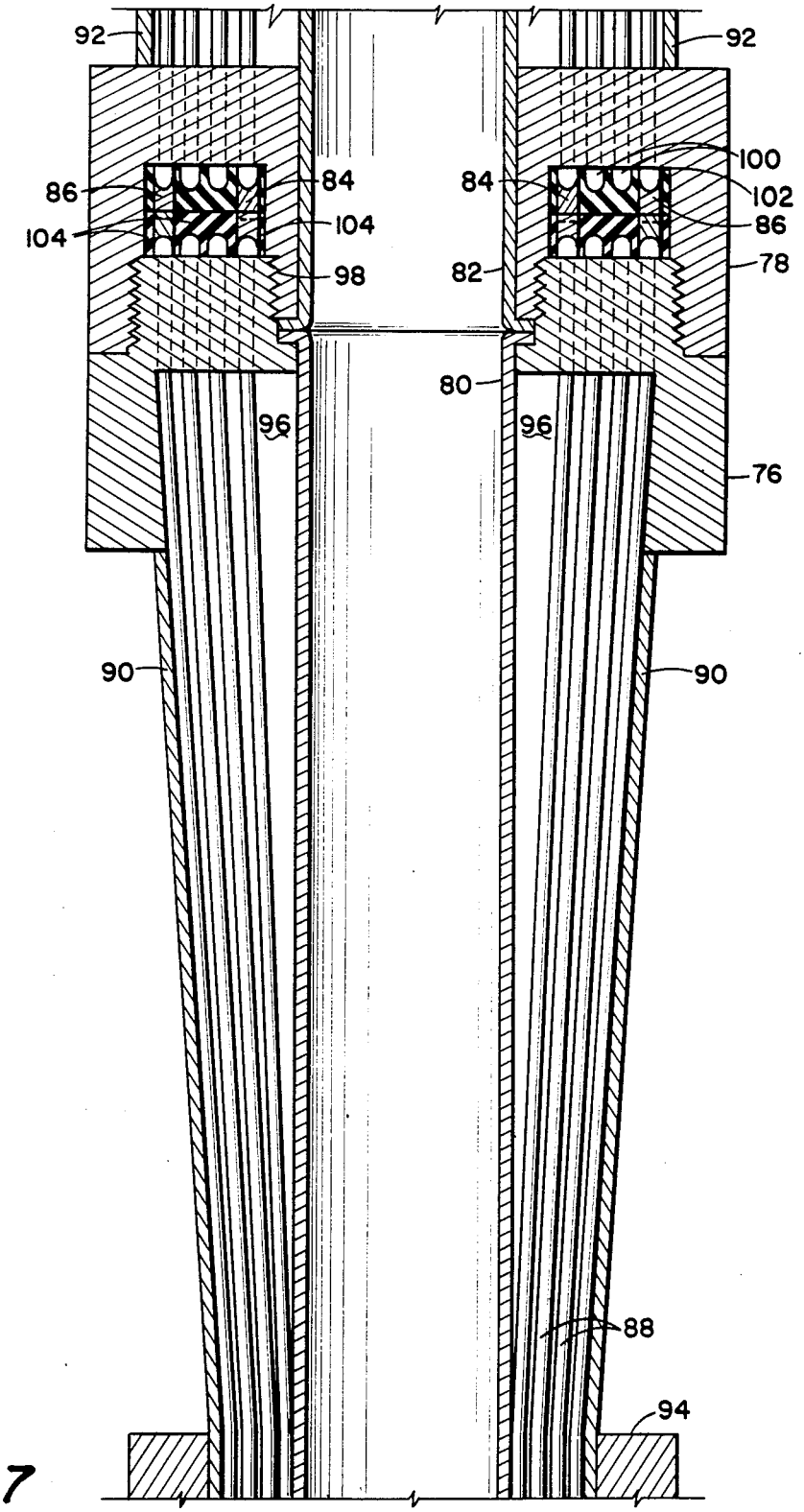
FIG. 7 illustrates a cross sectional view of an alternate pipe connection between two sections of drilling pipe.

FIG. 7 illustrates a cross sectional view of a pipe connection involving an alternate preferred embodiment of the present invention. Again, two drilling pipe sections are assembled as shown with the male connector 76 of the lower pipe section being threaded into the female connector 78 of the upper pipe until the inner cylindrical surfaces 80 and 82 and the electrical contact rings 84 and 86 of the respective pipes seat on each other. This embodiment differs from the embodiment of FIG. 1 in that the sidewalls of the pipe are made up of a plurality of essentially parallel, tightly packed wires 88 cemented to each other again creating a "reed bundling effect" within the annular space between the outer cylindrical surfaces 90 and 92 and inner surfaces 80 and 82, respectively. As in the previous embodiment, the wires 88 traverse the entire length of the pipe section terminating at the connectors. However, the wires 88 exiting the main portion of the pipe under clamp ring 94 (as illustrated) flare outward in the belled or conical region 96 between the clamp ring 94 and the connector 76. Thereafter, the wires 88 pass through a series of predrilled holes formed in the retaining ring 98 of connector 76. The wires are held in place under tension by buttons 100 within an annular cavity 102 between the connectors. This annular cavity is equipped with a pair of concentric electrical contact rings 84 and 86 involving an upper and lower ring similar to FIGS. 1 and 4. Elastomeric spacers 104 are provided within the annular cavity to hold the rings in place and to serve as seals.

The clamp rings of the embodiment of FIG. 7 are used at both ends of the pipe to keep the wires in a reed bundled assembly, rather than spreading out to conform to the larger diameter retainer ring holding the ends of the wire. These clamp rings will have an inside diameter sufficient only to allow the bundled wires to fit comfortably against the inner tube surface with no additional play. The outside diameter of the clamp ring will be such as to provide a metal thickness sufficient to restrain the tangential force of the wires from spreading to the natural spacing of the wire diameter located in the retainer rings. Preferably, the clamp rings are moved aa close as possible to the retainer rings without producing unnecessary stress in the individual wires which, in turn, would reduce the ultimate tension capabilities of the entire pipe assembly.

The rods and wires found in the sidewall structure of the drilling pipe of the present invention, when put under tensile loads characteristic of drilling, produce a banding effect which automatically resists tangential bursting to the centerline axis of the pipe. Although this tensile stressing produces resistance to the tangential bursting capacity, it does not resist the capacity to torsionally wind-up such as a helical spring. Therefore, greater torsional resistance can be developed by introducing some mechanical means of cementing one strand of wire to another. In the absence of cementing together the individual wire strands, the bundle of wires is subject to being twisted in a helical manner to form what might be envisioned as a wire cable or rope. This condition is undesirable. The presence of cement will produce a longitudinal shear resistance of one wire to another which will, in turn, eliminate the helical coiling effect.

In situations where some small torsional capabilities might be advantageous, the annular space within the sidewalls containing the rods of FIG. 1 (the interstitial space between rods) or the cone end or belled region between the connector and clamp ring, such as illustrated in FIG. 7, can be free or partially free of cement thus allowing for some wind-up. Preferably, this technique is employed to intentionally store rotational kinetic energy and thus produce a spring-loading effect on the drill bit itself.

Various methods of assembling and cementing the bundle of rods or wires can be employed in manufacturing the drilling pipe. For example, after completing the assembly of rods in the fusion block or the button heading of the individual wires on the retaining rings and the insertion of the inner tube, the entire assembly can be dipped or immersed in the cementitious material. The exterior surface can then be wrapped around the composite. Alternately, the entire pipe section can be assembled and the cementitious binding agent can be injected into the interior annular cavity containing the bundle of rods or wires through appropriate injection ports or the equivalent. Various other methods are contemplated as being equivalent for purposes of this invention, including concepts such as precoating the rod or wire prior to assembly and following assembly with a binding agent activation step, annealing and the like.

Electrical isolation of the conductive rods or wires employed to establish continuity from the surface of the earth to the subsurface location can be achieved by insulating the respective conductive rods or wires by any of the methods well known in the art. Electrical isolation can also be readily achieved by use of synthetic or polymeric non-conductive strans for the remainder of the rods or wires surrounding the conductive strands in combination with the use of a con-conductive plastic resin or the like as the cement.

Generally, the rods and wires that contribute exclusively to th.e structural integrity of the sidewall of the drilling pipe can be made of any conventional material compatible with the downhole drilling environment, including, but not limited to various metal rods and wires, synthetic fibrous strands, plastic composites containing synthetic or mineral fibrous strands, certain structural plastic rods and combinations thereof. Preferably, the wire employed is to be a low oost, high strength steel wire or a high strength, high temperature resistant polymeric fibrous material, such as the aromatic polyamides commonly referred to by the generic name "aramid" fibers and composites thereof.

The rods and wires employed to establish the electrical circuit are generally made from a strand or strands of inexpensive conductive metallic wire, preferably of copper, particularly if the electrical current is significant such as during downhole drilling motor applications. In situations involving transmission of data and the like, the wire can be much smaller and generally of any suitable conductive material. In one particular embodiment, the data transmission circuit is contemplated as being an optical fiber rather than a conductive stand and the alignment means for making contact between interconnected pipes is an optically polished interface. Such a structure should be considered equivalent for purposes of this invention.

The cement binding agent is preferably a low melting point metal such as lead, zinc and the like when employing metallic rods or wires, or a plastic resin such as epoxy, a cross-linked polyester, thermosetting resins or the equivalent when employing non-metallic and/or metallic rods and wires. When employing a fusion block to retain the rods and wires, the preferred composition for the fusion block is a nonconductive plastic resin as described above but again a low melting point metal should be considered equivalent. The size and number of rods or wires to be used can be selected according to the desired physical and structural properties of the drilling pipe. Preferably rods and wires having diameters measured in terms of about ½ inch or less are conveniently employed. The keyway system to interlock the drilling pipe joint when splined fittings are used can be essentially any such device commonly employed in the drilling industry including braided as well as rigid steel keyways.

Several advantages can be derived from using the improved drilling pipe of the present invention. First and foremost, by incorporating the conductive strands as an integral structural component of the drilling pipe, electrical continuity is maintained between the surface of the earth and a subsurface location without significantly deviating from the conventional methods of handling a string of drilling pipe. In other words, the drilling pipe and connections as illustrated in the figures can be assembled and disassembled during drilling operations without having to contend with auxiliary electrical cables and the like passing down the center of the pipe string. In fact, for all practical purposes the electrical connector rings can be present in the pipe connection with minimal attention. Thus, the present invention provides a method of drilling with a downhole electric motor involving the specific improvement of transmitting electrical current from the surface of the earth to a downhole electric motor through a drilling pipe as previously described. This method can also be generally extended to the delivery of electricity downhole for purposes other than drilling. By segmenting the electrical connector rings and maintaining axial alignment of the pipe connection, a plurality of conductive circuits can be established which allow for multiple simultaneous functions, such as driving an electric drilling motor and transmitting telemetry data or well logging data during the drilling operation. By providing the pipe with an optical fiber strand and the connector with polished optical interfaces even greater data transmission capabilities can be achieved.

Having thus described and exemplified the preferred embodiments with a certain degree of particularity, it is manifest that many changes can be made within the details of construction, arrangement and fabrication of components and method of assembly without departing from the spirit and scope of this invention. Therefore, it is to be understood that the invention is not limited to the embodiments set forth herein for purposes of exemplification, but is to be limited only by the scope of the attached claims, including the full range of equivalents to which each element thereof is entitled.

I claim:

1. A drilling pipe for maintaining electrical connection between the surface and a subsurface location comprising:

(a) a first fitting at one end of said pipe;

(b) a second fitting at the other end of said pipe adapted to connect with a fitting like that at the first end;

(c) a pipe sidewall interconnecting said end fittings and wherein said pipe sidewall substantially comprises a plurality of essentially parallel, tightly packed rods or wires cemented to each other wherein at least one of said rods or wires is electrically conductive and insulated from the rest of the pipe; and (d) an alignment means for making electrical contact between corresponding insulated rods or wires when said first fitting of one of said pipes is connected with said second fittinq of another of said pipes.

2. A drilling pipe of claim 1 wherein at least two separate subsets of said rods or wires are electrically insulated from the rest of the pipe and said subsets are isolated from each other thus completing an electrical circuit down the drilling string and back to the surface of the earth.

3. A drilling pipe of claim 2 wherein said alignment means comprises at least two concentric electrical contact rings at each end of said pipe fittings wherein said rings complete the electrical circuit between respective pipe sections when interconnected thus establishing electrical continuity and maintaining electrical isolation of said subsets of said insulated rods or wires.

4. A drilling pipe for maintaining electrical connection between the surface and a subsurface location comprising:

(a) a first fitting at one end of said pipe;

(b) a second fitting at the other end of said pipe adapted to connect with a fitting like that at the first end;

(c) a pipe sidewall interconnecting said end fittings and wherein said pipe sidewall substantially comprises a plurality of essentially parallel, tightly packed rods or wires cemented to each other wherein at least one of said rods or wires is electrically conductive and insulated from the rest of the pipe; and (d) an alignment means for making electrical contact between corresponding insulated rods or wires when said first fitting of one of said pipes is connected with said second fitting of another of said pipes wherein said pipe fittings are splined to maintain axial alignment of interconnected pipe sections and said splined fittings are retained in an assembled interconnected state by a concentric keeper means.

5. A method of drilling with a downhole electric motor involving the specific improvement of transmitting electrical current from the surface of the earth to said downhole electric motor through a drilling pipe comprising:

(a) a first fitting at one end of said pipe;

(b) a second fitting at the other end of said pipe adapted to connect with a fitting like that at the first end;

(c) a pipe sidewall interconnecting said end fittings and substantially comprising a plurality of essentially parallel, tightly packed rods or wires cemented to each other wherein at least one of said rods or wires is electrically conductive and insulated from the rest of the pipe; and (d) an alignment means for making electrical contact between corresponding insulated rods or wires when said first fitting of one of said pipes is connected with said second fitting of another of said pipes.

6. A method of measuring while drilling involving the specific improvement of transmitting electrical signals containing measurement data between the earth's surface and a downhole location through a drilling pipe comprising:

(a) a first fitting at one end of said pipe (b) a second fitting at the other end of said pipe adapted to connect with a fitting like that at the first end;

(c) a pipe sidewall interconnecting said end fittings and substantially comprising a plurality of essentially parallel, tightly packed rods or wires cemented to each other wherein at least one of said rods or wires is electrically conductive and insulated from the rest of the pipe; and (d) an alignment means for making electrical contact between corresponding insulated rods or wires when said first fitting of one of said pipes is connected with said second fitting of another of said pipes.

7. A method of claim 5 or 6 wherein at least two separate subsets of said rods or wires are electrically insulated from the rest of the pipe and said subsets are isolated from each other, thus completing an electrical circuit down the drilling string and back to the surface of the earth.

8. A method of claim 7 wherein said alignment means comprises at least two concentric electrical contact rings at each end of said pipe fittings wherein said rings complete the electrical circuit between respective pipe sections when interconnected thus establishing electrical continuity in maintaining electric isolation of said subsets of said insulated rods or wires.

9. A drilling pipe of claim 4 wherein at least two separate subsets of said rods or wires are elctrically insulated from the rest of the pipe and said subsets are isolated from each other thus completing an electrical circuit down the drilling string and back to the surface of the earth.

* * * * *